US007051889B2

(12) United States Patent
Boukobza

(10) Patent No.: US 7,051,889 B2
(45) Date of Patent: May 30, 2006

(54) THERMOPLASTIC CONTAINER WHEREOF THE BASE COMPRISES A CROSS-SHAPED IMPRESSION

(75) Inventor: Michel Boukobza, Octeville sur Mer (FR)

(73) Assignee: Sidel, Octeville-Sur-Mer (FR)

( * ) Notice: Subject to any disclaimer, the term of this patent is extended or adjusted under 35 U.S.C. 154(b) by 83 days.

(21) Appl. No.: 10/472,388

(22) PCT Filed: Apr. 2, 2002

(86) PCT No.: PCT/FR02/01134

§ 371 (c)(1),
(2), (4) Date: Sep. 23, 2003

(87) PCT Pub. No.: WO02/081312

PCT Pub. Date: Oct. 17, 2002

(65) Prior Publication Data

US 2004/0094502 A1 May 20, 2004

(30) Foreign Application Priority Data

Apr. 3, 2001 (FR) ..... 01 04516

(51) Int. Cl.
*B65D 1/02* (2006.01)

(52) U.S. Cl. ..... 215/375; 215/373; 220/606; 220/609

(58) Field of Classification Search ..... 215/373, 215/375, 371; 220/606, 608, 609
See application file for complete search history.

(56) References Cited

U.S. PATENT DOCUMENTS

| | | | | |
|---|---|---|---|---|
| 4,294,366 | A * | 10/1981 | Chang | 215/375 |
| 5,507,402 | A * | 4/1996 | Clark | 215/375 |
| 5,549,210 | A | 8/1996 | Cheng | |
| 5,785,197 | A * | 7/1998 | Slat | 215/375 |
| RE36,639 | E * | 4/2000 | Okhai | 215/375 |
| 6,260,724 | B1 * | 7/2001 | Young et al. | 215/375 |

FOREIGN PATENT DOCUMENTS

| | | |
|---|---|---|
| EP | 0 551 788 A | 7/1993 |
| EP | 0 574 342 A | 12/1993 |
| FR | 2 759 923 A | 8/1998 |
| JP | 07 132926 A | 5/1995 |

* cited by examiner

*Primary Examiner*—Sue A. Weaver
(74) *Attorney, Agent, or Firm*—Sughrue Mion, PLLC

(57) ABSTRACT

A thermoplastic container obtained by blow-molding of a preform, with a base including in its central part a multiple-branch cross-shaped impression provided with a central recess from which radial branches radiate; the base is of the petal-shaped type with at least three legs formed by protuberances located near the periphery; there are as many legs as branches mutually aligned radially; each leg includes a notch for absorbing stresses radially separated from the end of the respective branch.

6 Claims, 2 Drawing Sheets

THERMOPLASTIC CONTAINER WHEREOF THE BASE COMPRISES A CROSS-SHAPED IMPRESSION

FIELD OF THE INVENTION

The present invention relates to improvements made to thermoplastic containers, especially bottles, obtained by blow-molding or stretch-blow-molding of a preform, these containers comprising a side wall and a bottom connected to this side wall, said bottom comprising, in its central region, an impression in the shape of a multi-branch cross impressed into the outer face of the bottom wall, this cross-shaped impression having a roughly circular central hollow around which uniformly-spaced radially-extending branches radiate.

DESCRIPTION OF THE PRIOR ART

Containers, particularly bottles, thus formed can be filled with a hot liquid (that is to say one having a temperature at most equal to about 94° C.). The bottom of a container thus designed, the material of the central part of which has remained in the amorphous state and therefore has lower mechanical strength with respect to contact with the hot liquid, is mechanically strengthened by the multi-branch cross-shaped impression and will not deform under the effect of heat.

However, such containers cannot withstand a process of pasteurizing the liquid they contain (for example heat treatment at a temperature of the order of 70° C. for a time of the order of 20 minutes). During pasteurization, the liquid sees its volume increase appreciably under the action of the temperature, and the hot material in the bottom of the container is not capable of withstanding the increased stress without deforming.

The same problem is posed a fortiori, to a greater extent, when the liquid to be pasteurized, which is contained in the container, contains dissolved gas under pressure (carbonated liquid)—the case of beer for example. The material of the bottom of the container has not only to withstand the increased stress due to the increase in volume of the hot liquid, but has also to withstand the considerable increase in pressure of the hot gas. The aforesaid containers are unable to withstand such stresses without significant deformation of the bottom.

SUMMARY OF THE INVENTION

It is therefore an object of the invention to remedy this disadvantage and to propose an improved design of the bottom of the container that allows said container to withstand a pasteurization process without its bottom deforming.

To these ends, a thermoplastic container, particularly a bottle, as explained above, is characterized, being arranged according to the invention, in that the bottom is also of the petaloid type, with the bottom wall of a shape generally outwardly convex with at least three feet situated toward the periphery of the bottom and formed by uniformly angularly-spaced protrusions separated from one another by a convex wall portion of the bottom, in that there are equal numbers of feet and branches of the cross-shaped impression, in that the branches of the cross-shaped impression are arranged to correspond with the feet and aligned radially with respect to the latter, in that each foot has a stress-absorbing notch in its bearing part, and in that, in each foot, the stress-absorbing notch remains radially separate from the end of the corresponding branch of the cross-shaped impression.

Admittedly, the equipping of containers, such as bottles, with bottoms of petaloid type has long been known, and such bottoms are widely used in containers containing gasified liquids (carbonated liquids in particular): the radial hollows separating the "petal" feet are able to withstand the forces due to pressurization at the time of filling and keep the bearing surfaces of the feet coplanar and roughly perpendicular to the axis of the container.

In the context of the container according to the invention, the ability of the petaloid bottoms to correctly withstand the pressure inside the container is put to good use to allow the container, without deforming, to withstand the raised pressure due to the increase in volume of the liquid heated during the pasteurization process.

The container according to the invention combines the following positive and advantageous effects:

- on the one hand, of a petaloid bottom which without deformation withstands the increase in volume of the hot liquid, and
- on the other hand, of a bottom with a multi-branch star-shaped impression which can, without modifying the flatness of the feet of the petaloid part, deform and, by deforming inward, match the reduction in volume of the pasteurized liquid as it cools, this ability to undergo controlled deformation of the central part of the bottom (roughly in the region of the amorphous material) leading to a reduction in the deformation simultaneously experienced by the wall of the body of the container, which wall for this purpose is made in the form of juxtaposed panels; the consequence of this is that said panels provided on the wall of the body can be made with a smaller area, leaving greater freedom in the design of the container as a whole.

The advantages set out hereinafter still hold when the containers are filled with a still (ungasified) pasteurized liquid.

These advantages also hold, a fortiori, in the case of containers filled with a pasteurized liquid containing a dissolved gas under pressure (for example beer), these containers additionally being subjected to the raised pressure of the gases heated during pasteurization.

It will also be understood that, being able without damage to undergo the effects of pasteurization, the containers according to the invention are, a fortiori, capable without damage of undergoing hot filling (filling with a hot liquid at a temperature at most equal to about 94° C.).

Furthermore, the small amount of space available on the bottom for forming the petaloid pattern and the multi-branch cross impression is taken into consideration by geometrically combining the two patterns, with the branches of the cross-shaped impression arranged to correspond with the feet and aligned radially with respect to the latter.

Finally, because in each foot there is a stress-absorbing notch arranged as stated above, when a foot experiences stress, any resulting deformation is located at its notch. Furthermore, as the notch lies between two projections or pads of the foot via which the bottom rests on a support, the number of bearing points is thus doubled, something that helps give the container better stability.

In one embodiment, which gives the central part of the bottom better rigidity while at the same time allowing it the desired deformability needed for the purposes sought in the context of the invention, it is desirable for the roughly circular central bowl to have a depth significantly greater than that of the branches of the cross-shaped impression.

Advantageously, the portions of the convex wall of the bottom which separate two adjacent feet extend between the corresponding adjacent branches of the cross-shaped impression more or less as far as the edge of the central cup. However, to avoid weakening at the center, it is preferable for the aforesaid portions of the convex wall of the bottom which separate two adjacent legs not to open into the central cup and for their end situated radially toward the center to remain separated from the central cup by a rim, which rims help to stiffen the periphery of the central hollow.

Implementing the arrangements according to the invention entails reaching a compromise in order to arrive at a container bottom which has the desired qualities. What happens is that the petaloid bottom may, in principle, have any number, even a high number, of feet. Likewise, the hollow impression in the shape of a multi-branch cross may, in principle, have any number, even a high number, of branches. However, because, according to the preferred embodiment of the invention indicated above, the branches of the cross-shaped impression have a radial span that causes them, in part, to reach the beginning of the petals that constitute the feet and the branches of the cross-shaped impression also have a substantial width, this means that, in the container of the invention, it is not possible to provide a substantial number of feet and branches in the cross-shaped impression. In practice, this number has to be greater than three (the minimum number required to ensure that the container will stand stably), but exceeding five would not seem to be possible. In practice, four seems to be the best compromise.

It will also be noted that the thickness of the bottom does not need to be excessive, tests having shown that thick bottoms lead to mediocre results.

For this purpose, it will be pointed out that the thickness of the bottom of the container arranged according to the invention is appreciably less than that of the bottom with a single multi-branch cross-shaped impression provided in a container intended only for hot filling: use of the devices of the invention allows an appreciable reduction, of the order of 20 to 30% for the bottom alone and of the order of 3 to 10% for the container as a whole, in the amount of material used, depending on the type of container. This thus results in a considerable saving in monetary terms, making the arrangements of the invention advantageous even if only for application to containers appropriate for hot filling.

BRIEF DESCRIPTION OF THE DRAWINGS

The invention will be better understood from reading the detailed description which follows of a preferred embodiment given solely by way of illustration. In this description, reference is made to the attached drawings, in which.

DETAILED DESCRIPTION OF THE INVENTION

The description which follows relates more specifically, because it would seem that this is a preferred application of the arrangements of the invention, to a design of bottom for a bottle intended to contain a liquid, it being understood that this arrangement may just as easily relate to a container of another type, such as a flask or can, etc.

The invention is concerned with a container made of thermoplastic, for example of PET, obtained by blow-molding or stretch-blow-molding of a preform already obtained by molding.

Figure 2A:
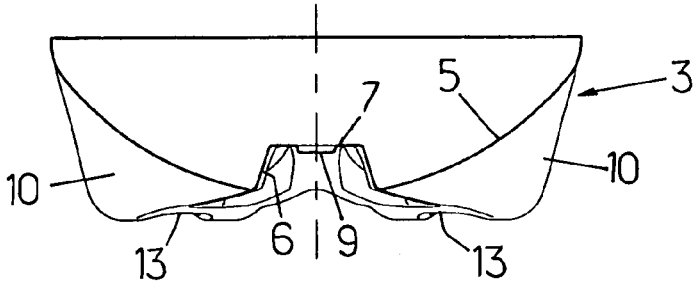
FIGS. 2A and 3A are views in diametral section on IIA—IIA and IIIA—IIIA of FIG. 1, respectively.
Figure 2B:
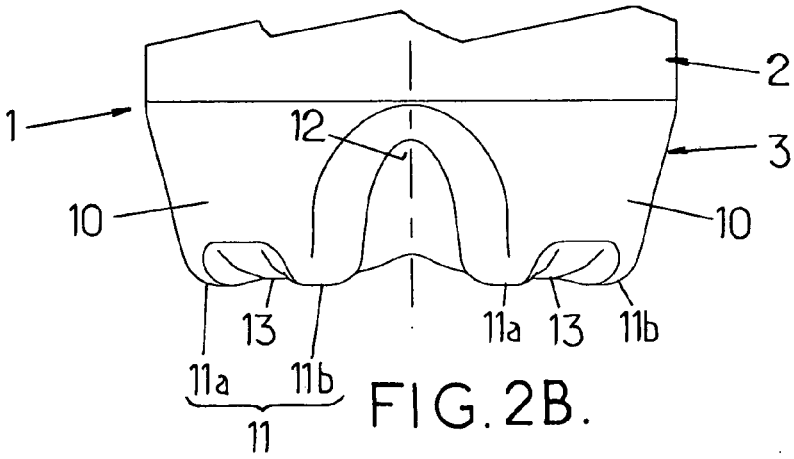
FIGS. 2B and 3B are side views, in the direction of arrows IIB and IIIB of FIG. 1, respectively, of the bottom of the container of FIG. 1.
Figure 3A:
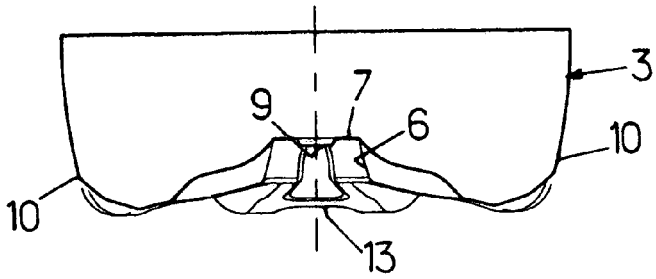
Figure 3B:
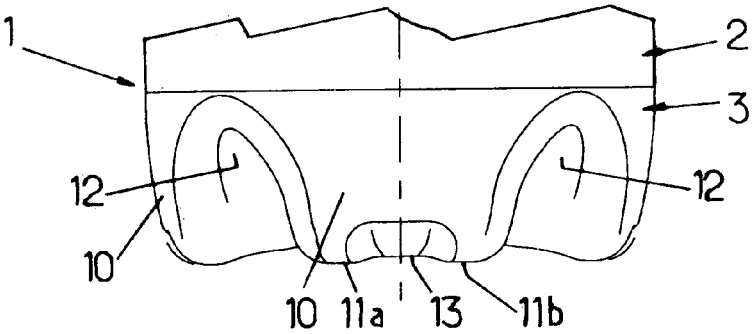
Figure 4:
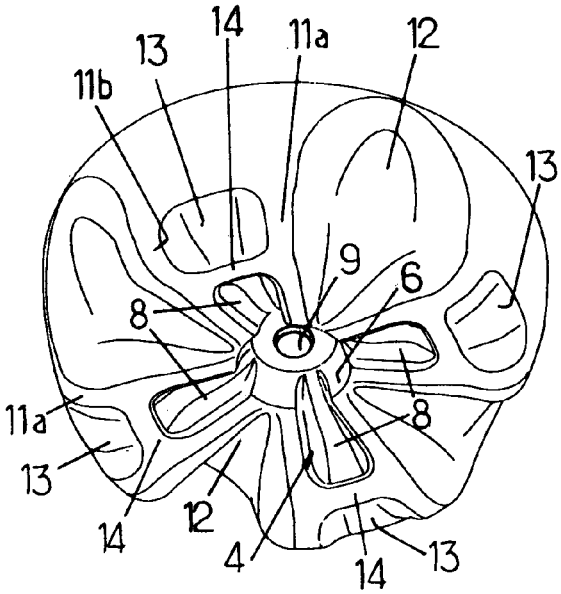
FIG. 4 is a three-quarters view from beneath of the bottom of the container of FIGS. 1 to 3.
Figure 5:
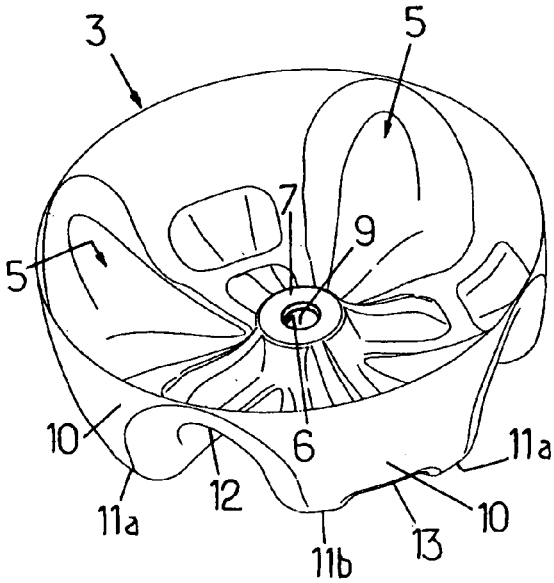
FIG. 5 is a three-quarters view from above of the bottom of the container of FIGS. 1 to 4, the body of the container having been assumed to have been removed.

The bottle, denoted in its entirety by the reference 1 in FIGS. 2B and 3B (in which only the lower part of the bottle can be seen) comprises a side wall 2 and a bottom 3 connected to this side wall.

The bottom 3 comprises, in its central region, an impression 4 in the shape of a multi-branch cross impressed into the outer face of the bottom wall 5. The cross-shaped impression 4 has a roughly circular central cup 6 (which results in a roughly round plateau 7 projecting into the bottle) at the center of which there is a knob or lump 9 of material corresponding, in the known way, to the site of the point of injection of the preform. Around the central cup 6 there radiate the branches 8 which extend radially and are equally spaced.

In the example illustrated, the branches 8 of the cross-shaped impression 4 are four in number, spaced apart by 90°, for a reason which will be explained later on.

The branches 8 of the cross-shaped impression 4 have fairly large dimensions, with a pronounced relief. For example, the branches 8 have parallel edges giving them a rectangular individual shape or, as illustrated, edges which diverge somewhat toward the periphery, giving them a roughly trapezoidal shape. Their length is approximately twice their mean width, and their mean depth is approximately half their mean width.

The cross-shaped impression 4 is formed in the central region of the bottom wall 5 in which the thermoplastic has remained amorphous.

Furthermore, the bottom 3 is shaped in the "petaloid" style with the bottom wall 5 having a generally outwardly convex shape. Formed in the bottom wall 5 are protrusions 10 protruding outward and situated toward the periphery of the bottom; more precisely, the most protruding part 11 of the protrusions 10 lies near the periphery of the bottom while the protrusions slope down gently toward the center of the bottom. The protrusions 10 are spaced at uniform angles and separated from one another by a convex bottom wall portion, which constitutes a radially extending valley 12 separating two adjacent protrusions.

The protrusions 10 constitute feet, the most protruding part 11 of which is the bearing region via which the container rests on a support.

Figure 1:
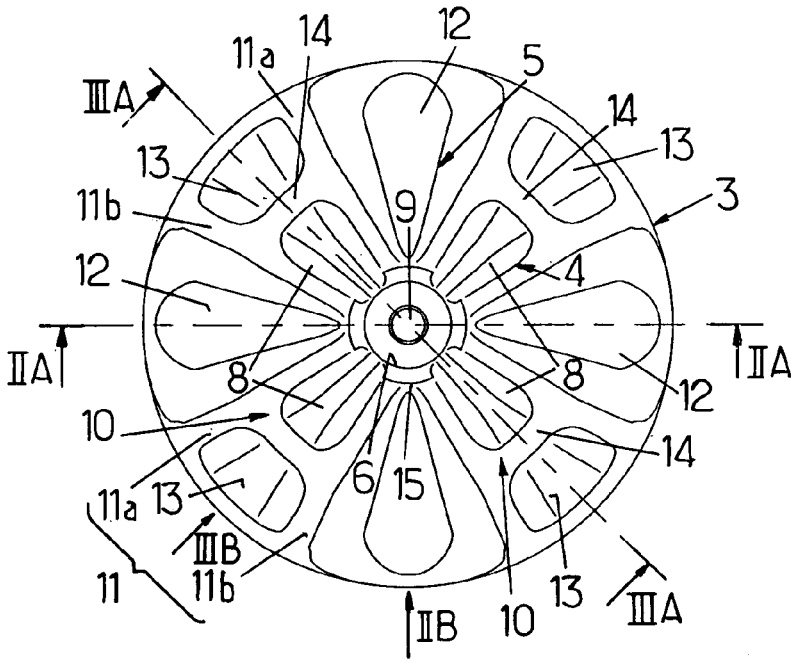
FIG. 1 is a view from beneath of a container bottom arranged according to the invention.

As illustrated, the protrusions or feet 10 and the branches 8 of the cross formed by the central impression 4 are equal in number because, as can be seen particularly clearly in FIG. 1, the branches 8 of the cross-shaped impression are engaged, at least toward their respective ends, in the feet 10, at least in the least protruding part thereof. In other words, the feet 10 and the branches 8 are not only equal in number but are also radially aligned with each other.

Such a configuration is, in practice, dictated by the need to have at least three feet in order for the container to be able to rest stably on a support and by the need to have branches 8 of the cross-shaped impression 4 which have a substantial relief and substantial dimensions, particularly in terms of their width.

As a result, the number of feet, and therefore the number of branches 8 of the cross-shaped impression 4, cannot be less than three, but conversely cannot, in practice, be too high, because of the requirements involved in obtaining correct shapes by means of blow-molding during manufacture.

In practice, it would seem that four is a good compromise, as illustrated in FIGS. 1 to 5, for a bottle of standard dimensions.

For the bottom 3 to have good rigidity when it is in use, while at the same time having a relative ability to deform in the presence of hot liquid, it is desirable to provide appropriate reinforcing elements.

Hence, it is advantageous for the convex wall portions or valleys 12 which separate two adjacent feet to extend between two consecutive branches 8 of the central cross-shaped impression practically as far as the edge of the central cup 6, without, however, opening into this cup, and leaving between their radially inner end and the central cup 6 a slight rim 15 that acts as a reinforcement.

In addition, the most protruding part 11 of the feet 10 is not smooth, but has a depression or notch 13 with the concave portion facing outward. When a foot 10 experiences stress, any deformation that may result from this stress is therefore located at this notch 13, known as a stress-absorbing notch.

As a side issue, the presence of the stress-absorbing notch 13 demarcates two bearing regions 11*a* and 11*b* situated one on each side of this notch. This doubles the number of bearing regions, of which there are not four (in the example considered) corresponding to the number of feet, but eight. This gives the container resting on a support better stability.

What is more, this arrangement of each foot 10 reveals the transverse strip 14 between the radially outer end of each branch 8 of the central cross-shaped impression 4 and the stress-absorbing notch 13 of the foot 10, which is situated in the continuation of this branch. The transverse strip 14 serves, on the one hand, to stiffen the gently sloping part of the foot 10 by bracing the two radially extending lateral edges of the foot 10 and, on the other hand, serves as an articulation for the central part of the bottom stiffened by the cross-shaped impression 4 when this central part is sucked inward as the liquid cools. This ability the bottle has to move inward in a controlled manner as the container cools leads to less stress on the panels of the wall of the body of the bottle, thus allowing the area of said panels to be reduced.

The bottle thus formed may, without appreciable deformation of its bottom, undergo a process of pasteurizing its liquid contents, whether these be a still liquid (for example a fruit juice) or liquid containing dissolved gas or a carbonated liquid (for example beer). Such a bottle may, a fortiori, withstand a hot filling process.

It will be emphasized that the material of which the bottom is made has a relatively small thickness, by comparison to containers of the prior art (reduced for example by the order of 20 to 30%). The bottle of the invention is, from this point of view, far more advantageous than the current bottles suited to hot filling, which have an appreciably thicker bottom, in the case of bottles of the same type.

The invention claimed is:

1. A thermoplastic container obtained by blow-molding or stretch-blow-molding of a preform, this container comprising a side wall and a bottom connected to this side wall, said bottom comprising, in its central region, an impression in the shape of a multi-branch cross impressed into the outer face of the bottom, this cross-shaped impression having a roughly circular central cup around which uniformly-spaced radially-extending branches radiate, wherein said bottom is of the petaloid type, with the bottom having a shape generally outwardly convex with at least three feet situated toward the periphery of the bottom and formed by uniformly angularly-spaced protrusions separated from one another by a convex wall portion of the bottom, wherein there are equal numbers of feet and branches of the cross-shaped impression, wherein the branches of the cross-shaped impression are arranged to correspond with the feet and aligned radially with respect to the feet, wherein each foot has a stress-absorbing notch in its bearing part, and wherein, in each foot, the stress-absorbing notch remains radially separate from the end of the corresponding branch of the cross-shaped impression.

2. The container as claimed in claim 1, wherein said roughly circular central cup has a depth significantly greater than that of the branches of the cross-shaped impression.

3. The container as claimed in claim 2, wherein said portions of the convex wall of the bottom which separate two adjacent feet extend between the corresponding adjacent branches of the cross-shaped impression more or less as far as the edge of the central cup.

4. The container as claimed in claim 2, wherein said portions of the convex wall of the bottom which separate two adjacent feet extend between the corresponding adjacent branches of the cross-shaped impression to near the edge of the central cup, wherein said portions of the convex wall of the bottom which separate two adjacent legs do not open into the central cup, and wherein the end thereof situated radially toward the center remain separated from the central cup by a rim.

5. The container as claimed in claim 1, wherein, in each foot, the radially outer end of the branch of the cross-shaped impression and the stress-absorbing notch are separated by a transverse strip.

6. The container as claim in claim 1, wherein said bottom has four feet, and wherein the cross-shaped impression is in the shape of a cross with four branches.

* * * * *